US006105379A

United States Patent [19]

Alsenz et al.

[11] Patent Number: 6,105,379

[45] Date of Patent: Aug. 22, 2000

[54] SELF-ADJUSTING VALVE

[75] Inventors: Richard H. Alsenz; Roger C. Ansted, both of Houston; Barry Bryson, Waller; Jeffrey W. Johnson, Sugarland; Paul Malone; Collin A. Rose, both of Houston, all of Tex.

[73] Assignee: Altech Controls Corporation, Missouri City, Tex.

[21] Appl. No.: 08/818,704

[22] Filed: Mar. 14, 1997

Related U.S. Application Data

[63] Continuation-in-part of application No. 08/616,412, Mar. 15, 1996, abandoned, and a continuation-in-part of application No. PCT/US94/10255, Aug. 25, 1994

[60] Provisional application No. 60/039,279, Feb. 28, 1997.

[51] Int. Cl.[7] ..... G05D 23/12

[52] U.S. Cl. ..... 62/225; 236/92 B

[58] Field of Search ..... 236/92 B; 62/225, 62/210, 211

[56] References Cited

U.S. PATENT DOCUMENTS

| | | | |
|---|---|---|---|
| 2,363,010 | 11/1944 | Matteson | 62/127 |
| 2,529,378 | 11/1950 | Dube et al. | 236/92 |
| 2,550,022 | 4/1951 | Ray | 236/92 |
| 2,579,034 | 12/1951 | Dube et al. | 62/8 |
| 2,856,759 | 10/1958 | Barbulesco | 62/211 |
| 3,316,731 | 5/1967 | Quick | 62/196 |
| 3,405,535 | 10/1968 | Matthies | 62/202 |
| 3,427,819 | 2/1969 | Seghetti | 62/196 |
| 3,822,563 | 7/1974 | Orth | 62/217 |
| 4,032,070 | 6/1977 | Nielsen | 236/92 |
| 4,437,317 | 3/1984 | Ibrahim | 62/81 |
| 4,475,686 | 10/1984 | Huelle et al. | 236/68 |
| 4,500,035 | 2/1985 | Kuroda et al. | 236/92 |
| 4,625,524 | 12/1986 | Kimura et al. | 62/278 |
| 4,651,535 | 3/1987 | Alsenz | 62/225 |
| 4,688,390 | 8/1987 | Sawyer | 62/160 |
| 4,840,038 | 6/1989 | Sato | 62/210 |
| 5,148,978 | 9/1992 | Stapelbroek | 236/68 |
| 5,361,597 | 11/1994 | Hazime et al. | 62/205 |
| 5,396,780 | 3/1995 | Bendtsen | 62/212 |
| 5,588,590 | 12/1996 | Sakakibara et al. | 236/92 |

*Primary Examiner*—William E. Tapolcai

[57] ABSTRACT

The present invention discloses an automatic self-adjusting thermally powered expansion valve for controlling the flow of refrigerant to an evaporator of a refrigeration system. The valve includes a differential fluid amplifier transducer which produces a constant flow of refrigerant independent of the liquid line pressure and includes a generally cylindrical interior with an inlet chamber having an inlet port and an outlet chamber having an outlet port and an orifice between the chambers providing a passage for the flow of refrigerant through the valve. The flow of refrigerant through the valve is regulated by a valve element, which moves longitudinally within the chambers with respect to the orifice. The longitudinal position of the valve element is controlled by force generators and sensors. The position of the valve element depends on the fluid pressure and the size of the pressure disks, and the spring constant of the compression spring. As the temperature at the sensors increases, so to does the pressure force on the pressure disks.

15 Claims, 5 Drawing Sheets

SELF-ADJUSTING VALVE

RELATED APPLICATIONS

The present application claims the benefit of U.S. provisional application Ser. No. 60/039,279, filed Feb. 28, 1997 entitled Self-Adjusting Valve and is a continuation-in-part application of U.S. patent application, Ser. No. 08/616, 412 filed Mar. 15, 1996 now abandoned , and PCT International Application Number PCT/US94/10255 filed Aug. 25, 1994, all of these applications being incorporated herein by reference.

BACKGROUND OF THE ART

The present invention relates to an apparatus and method for automatically controlling fluid flow through a valve in response to system changes and more particularly to a self-adjusting valve which automatically adjusts the refrigerant flow through an evaporator in a refrigeration system.

Mechanical expansion valves frequently are used in refrigeration systems to meter the liquid refrigerant flow into an evaporator coil. A type of mechanical expansion valve commonly used contains a body having an inlet port and an outlet port and a movable valve, or closure, element placed within the body for opening and closing the valve orifice. A compression spring is placed at one end of the valve element to apply a force to it in a first direction. A second force generator, such as a fluid-filled bellows or diaphragm, is placed against the other end of the closure element to provide a force against it representative of a system parameter, such as the outlet temperature of the evaporator coil, in a second direction that is opposite to the direction of the force provided by the compressed spring. The second force generator is coupled in fluid communication with a thermal probe, with the second force generator, the probe and the communication conduit therebetween being filled with an appropriate fluid. The probe typically is attached thermally to the evaporator coil outlet. As the temperature of the probe changes, the pressure in the probe, and thus in the second force generator, changes, causing the bellows or diaphragm, for example, to expand or to contract, thereby providing a force at the closure device that is representative of the temperature of the region where the probe is located, such as at the evaporator coil outlet. Examples of various valves may be found in U.S. Pat. Nos. 4,651,535; 5,026,022; 5,065,595; 5,148,684; 5,232,015 and 5,238,219.

Such expansion valves, however, do not have a single set point and, therefore, must be adjusted in response to a change in the operating conditions of the refrigeration system. Such adjustments can be both time-consuming and may necessitate disassembling the system to obtain access to the valve. In addition, if the valve is not adjusted, operating problems and/or power inefficiencies in the refrigeration system operation will typically be the end result. Because, as a practical matter, valves cannot be adjusted continuously in response to every change affecting the operation of the refrigeration system, refrigeration systems have inherent power inefficiencies. Thermomechanical expansion valves which permit remote adjustments to the valve stem have been developed to alleviate the necessity of disassembling the system for adjustment. These devices, however, are susceptible to undesirable leakage and require continued readjustment.

Other attempts have been made to solve some of the aforementioned problems and to increase the power efficiencies of these systems by making the inlet and outlet ports balanced, thus making the opening forces of the valve orifice independent of the pressure drop across the orifice. The problem with these mechanisms is that they fail to compensate for variable flow through the orifice. The flow through an orifice varies as the square root of the pressure drop across the orifice.

The tonnage of a refrigeration system equates to the amount of refrigeration that the system will achieve, i.e. the number of BTUs that it will remove from the refrigerated area. One method of increasing the tonnage of a refrigeration system is to increase the load, i.e. the volumetric flow of the refrigerant through the system. Flow may be increased by increasing the liquid line pressure upstream of the evaporator. A conventional expansion valve is sized for a particular load or refrigerant flow through the system because it is dependent on the liquid line pressure and thus has an orifice sized for a predetermined flow through the valve. The larger the load, the larger the valve orifice. Therefore, a conventional expansion valve has only a limited range of permitted flow through the valve. For example, if the flow is doubled, another expansion valve with a larger orifice must be used because a conventional valve will not operate over a wide range of volumetric flow rates. Further, this deficiency requires that fluctuating liquid line pressures be avoided.

Since conventional expansion valves are dependent on the liquid line pressure, attempts are made to maintain a constant liquid line pressure. This requires that the liquid line pressure be maintained at the high summer pressures even during the colder winter months. Operating the refrigeration system at artificially high pressures during the winter wastes energy and adds expense to the operation of the system. Running at higher discharge pressures also results in higher compressor operating temperatures which decreases the life expectancy of the compressor.

The present invention overcomes these deficiencies of the prior art.

DISCLOSURE OF INVENTION

The present invention provides a method and apparatus for controlling the flow of refrigerant fluid in a refrigeration system, which is automatically responsive to a change in the parameters of the system. More particularly, the present invention provides method and apparatus for controlling the flow of refrigerant in a refrigeration system by providing an automatic continuously self-adjusting thermally powered expansion valve. In a refrigeration system wherein air is cooled by passing externally by an evaporator of the system, a sensor senses the temperature of the air flowing past the evaporator and applies a quantity of fluid pressure that is representative of the temperature of the air to configure the valve to control the flow of refrigerant to the evaporator. The configuring of the valve controls the flow of refrigerant to maintain the temperature at the outlet end of the evaporator, lower than the temperature of the air external to the evaporator and higher than the temperature within the evaporator; the flow of refrigerant decreases when the difference between the temperature at the outlet end of the evaporator and the temperature within the evaporator decreases, or the difference between the temperature of the air external to the evaporator and the temperature within the evaporator increases.

A temperature sensing probe may be used for sensing the temperature at the outlet end of the evaporator and another sensor in the valve for sensing the temperature of the air external to the evaporator. Forces that are representative of the sensed temperatures and of the pressure in the evaporator are generated to control the configuration of the valve. The flow of refrigerant to the evaporator is thus increased when the temperature of the air external to the evaporator decreases, or the temperature at the outlet end of the evaporator increases, or the pressure in the evaporator decreases. Likewise, the flow of refrigerant is decreased when the temperature of the air external to the evaporator increases, or the temperature at the outlet end of the evaporator decreases, or the pressure in the evaporator increases.

Two force generators, operable by application of fluid pressure thereto, are provided to operate in generally opposite directions to configure the valve. Each of the probe and sensor is in communication with one of the force generators so that one force generator generates force representative of the temperature sensed by the temperature sensing probe and the other force generator generates force representative of the temperature of the valve sensor. The force generators apply force in generally opposite directions to a valve element whose position in a valve body determines the flow passage area for flow of refrigerant through the valve. Fluid pressure is communicated to the valve element from within the evaporator as well so that forces representative of the two sensed temperatures and of the pressure within the evaporator configure the valve.

One of the force generators may generate a force greater than the force generated by the other force generator in response to the same quantity of fluid pressure applied to each of the force generators. In a particular embodiment, the two force generators may comprise pressure disks such that the operable area of one pressure disk for generating force for configuring the valve is larger than the operable area of the other pressure disk.

The present invention provides method and apparatus for controlling the flow of refrigerant in a refrigeration system by the generation of forces representative of parameters of the refrigeration system, including the temperature of the air flow by the evaporator of the system, for example, wherein the forces are so produced ratiometrically, that is, proportional to the difference in the operative areas of the two force generators of the valve of the invention for producing force to configure the valve. A feedback restriction in the outlet allows the valve to function as a fluid amplifier.

A valve according to the present invention is self-adjusting, that is, the valve adjusts automatically in response to changes in the parameters of the system employing the valve such as the air being cooled by a refrigeration system; the valve is thermally powered, that is, the configuration of the valve is determined and changed by forces that are generated by heat changes and according to differences in temperatures; and the valve is mechanically self-adjusted, that is, the thermal powering of the valve configuration changes is effected utilizing fluid pressure applied to the valve components in response to air temperature changes.

A feedback pressure is placed on volumetric flow through the valve, thus causing the valve to be independent of the liquid line pressure. Making the port balanced and configuring the feedback allow the valve to function independently of the liquid line pressure. The flow at the outlet of the valve is restricted so as to place a negative feedback pressure on flow through the valve. This allows the valve to operate over a wide range of loads on the refrigeration system and avoids placing an artificially high pressure on the liquid line to maintain the operation of the valve. Thus, the valve of the present invention has greater flexibility than that of conventional valves and reduces operational cost.

Other objects and advantages of the invention will appear from the following description.

BRIEF DESCRIPTION OF DRAWINGS

For a detailed description of the preferred embodiment, reference will now be made to the accompanying drawings wherein.

DESCRIPTION OF THE PREFERRED EMBODIMENT

Figure 1:
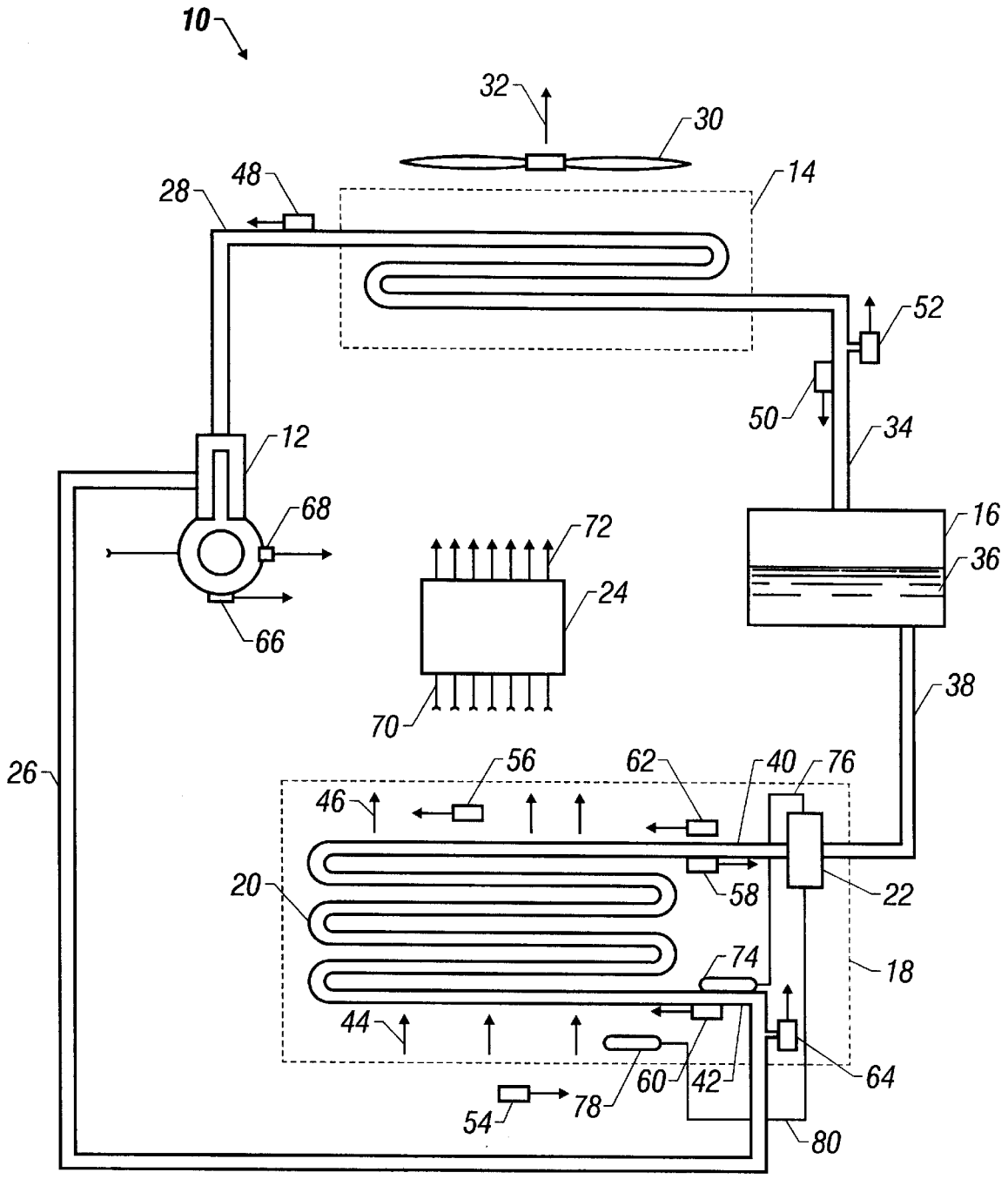
FIG. 1 is a schematic illustration of a closed loop vapor cycle refrigeration system utilizing a self-adjusting thermally powered expansion valve according to the present invention.

A closed loop vapor cycle refrigeration system 10 is shown generally in FIG. 1. The refrigeration system 10 preferably includes a compressor 12 for compressing a low pressure gas refrigerant, a condenser 14 for condensing the compressed gas refrigerant to a liquid, a receiver 16 for receiving and storing the liquid refrigerant, and an evaporator system 18 including an evaporator coil 20 for evaporating the liquid refrigerant to the low pressure gas. The evaporator system 18 further includes a self-adjusting thermally powered mechanical expansion valve 22 coupled to the evaporator coil 20 for controlling the flow of refrigerant to the evaporator coil. See also U.S. patent application Ser. No. 08/616,412 filed Mar. 15, 1996 and PCT International application No. PCT/US94/10255 filed Aug. 25, 1994 entitled Self-Adjusting Superheat Valve, both incorporated herein by reference. The refrigeration system 10 also features a microcontroller circuit 24 for controlling the operation of the system in response to various system parameters in accordance with programmed instructions. Various sensors, identified below, provide information about selected system parameters of the refrigeration system 10 to the control circuit 24.

The compressor 12 preferably receives the low pressure gas refrigerant from the evaporator coil 20 by way of a suction line 26 and compresses the low pressure gas to a high pressure and high temperature gas refrigerant. The high pressure gas refrigerant is conducted by way of a line 28 to the condenser 14. A fan 30 at the condenser 14 causes air to flow across the condenser 14, as indicated by the arrow 32, thereby condensing the compressed gas refrigerant to a liquid. The fan 30 may be of any appropriate type, including a fixed or variable speed type. The air 32 flowing across the condenser 14 removes thermal energy of condensation from the refrigerant in the condenser and causes the refrigerant to condense to liquid. The liquid refrigerant from the condenser 14 discharges by way of a liquid return line 34 to the receiver or reservoir 16 where the liquid is stored as indicated at 36. A conduit 38 conveys the liquid refrigerant from the reservoir 16 to the inlet side 174 of the expansion valve 22 best shown in FIG. 2. The valve 22 is located between the reservoir 16 and the inlet end 40 of the evaporator coil 20 for controlling the flow of refrigerant from the reservoir to the evaporator coil.

The liquid refrigerant enters the inlet end 40 of the evaporator 20 at a temperature $T_1$. Temperature $T_1$ is the boiling temperature of the liquid refrigerant which is determined by the capacities of the compressors. In progressing along the evaporator coil 20, the refrigerant fluid absorbs thermal energy by evaporating due to the external contact of the air as it flows over the coil, and evaporates to the gaseous state for egress through the outlet end 42 of the coil 20 at a temperature $T_2$ and returns to the compressor 12 along the suction line 26. The flow path of refrigerant around the refrigeration system 10 is thus a closed loop or circuit. Ambient air flows into the evaporator system 18 and over the evaporator coil 20 as indicated by the arrows 44 at a temperature $T_A$. The ambient air, that is cooled by removal of thermal energy to evaporate the refrigerant in the evaporator coil 20, is discharged from the area of the coil 20 as indicated by the arrows 46. The cooling of the ambient air flow 44 and 46 establishes the useful refrigeration effect. The ambient air may be circulated so that the flow 44 into the evaporator system 18 is return air that is to be cooled again after absorbing thermal energy.

In the preferred embodiment, appropriate sensors are positioned throughout the refrigeration system 10 to generate electrical signals representative of the temperature or fluid pressure at respective locations. The electrical signals are conveyed to the control circuit 24 for processing and utilization by the control circuit in the operation of the system 10. For example, a temperature sensor 48 is placed in the liquid flow conduit 28 to obtain a signal that is representative of the temperature of the liquid entering the condenser 14. A temperature sensor 50 and a pressure sensor 52 may be positioned along the liquid return line 34 to the reservoir 16 to provide electrical signals representative of the temperature and pressure, respectively, of the refrigerant in that return line 34.

A temperature sensor 54 is placed in the evaporator system 18 in the path of the return air flow 44 to provide an electrical signal representative of the temperature $T_A$ of the return air. A temperature sensor 56 is positioned in the path of the discharge air flow 46 from the evaporator system 18 to provide a signal representative of the temperature of the air leaving the evaporator coil 20. Temperature sensors 58 and 60 are positioned at the inlet end 40 of the evaporator coil 20 and at the outlet end 42 of the coil, respectively, to provide signals representative of the temperature $T_1$ of the refrigerant entering and of the temperature $T_2$ of the refrigerant leaving the evaporator coil 20. Additionally, pressure sensors 62 and 64 are connected to the inlet end 40 and the outlet end 42 of the evaporator coil 20 to provide signals that are representative of the pressure of the refrigerant at the coil inlet and outlet ends.

Additional temperature sensors, such as 66 and 68, may be located in the compressor 12 to determine the temperature of the compressor crankcase and the temperature of the oil in the compressor, respectively.

The microcontroller circuit 24 includes a microprocessor, appropriate analog-to-digital converters and comparators, for example, and switching circuitry. The control circuit 24 is operatively coupled to the temperature sensors 48, 50, 54, 56, 58, 60, 66 and 68, the pressure sensors 52, 62 and 64, the compressor 12 and the fan 30 by appropriate conductors (not shown). Outgoing arrows as parts of the sensor symbols and inward arrows 70 at the controller circuit 24 indicate that the sensors are operatively coupled to and provide relevant information signals to the controller. Similarly, outgoing arrows 72 at the microcontroller 24 and inward arrows as parts of the symbols of system components, such as the compressor 12 and the fan 30, indicated that the microcontroller circuit is operatively connected to these components by appropriate conductors (not shown) for controlling their operation by appropriate operation command and control signals. During operation of the system 10, the control circuit 24 continually receives information from the various sensors of the system and, in response thereto, controls the operation of various system components, such as the compressor 12 and the fan 30, in accordance with instructions provided to or stored in the circuit 24. An output of controller circuit 24 is used to apply voltage to heater 164, best shown in FIG. 2, to decrease or stop the flow of refrigerant through the valve 22.

Figure 2:
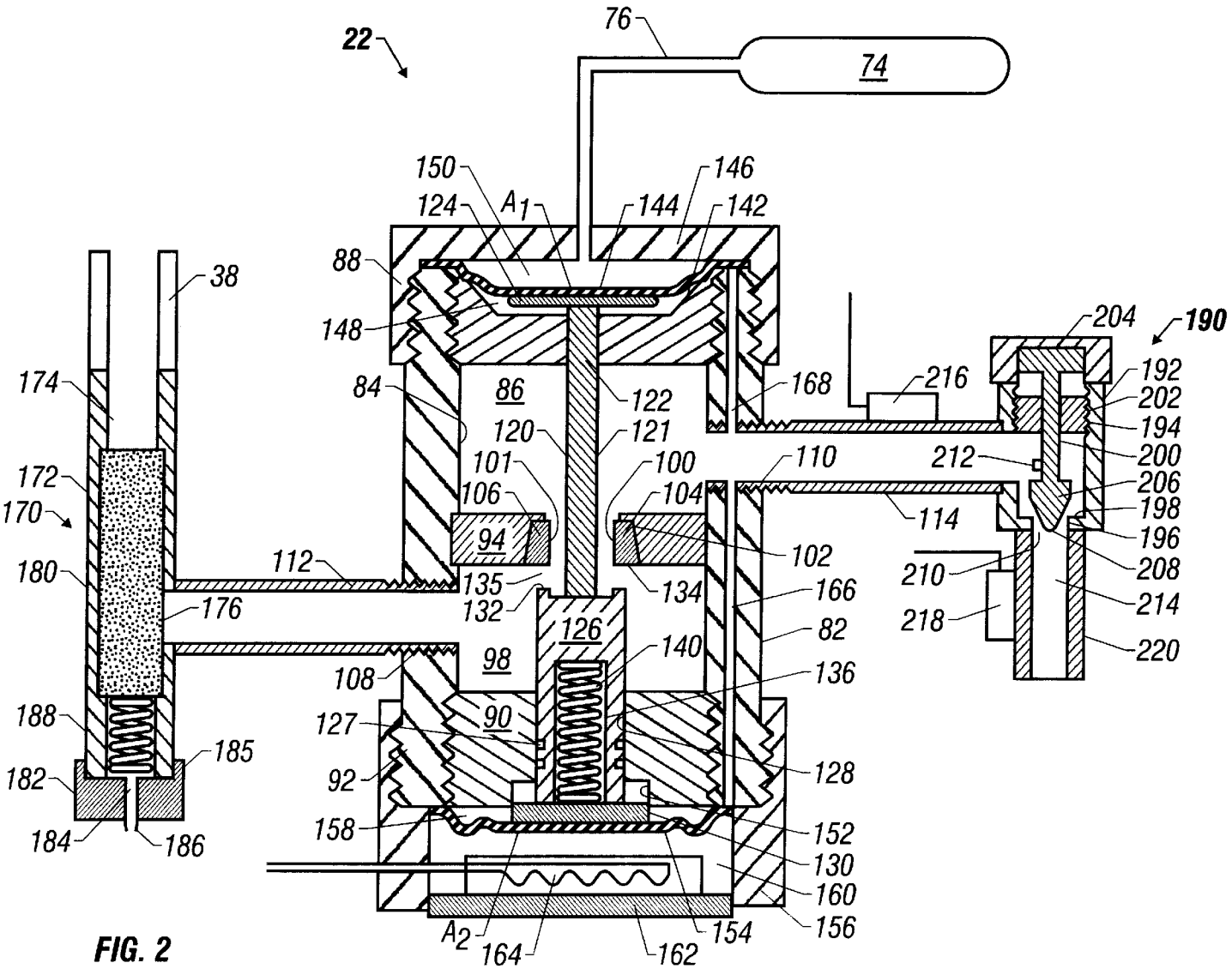
FIG. 2 is an enlarged, cross-sectional view of an expansion valve according to the present invention utilized in the system illustrated in FIG. 1.

Referring now to FIG. 2, one preferred embodiment of the expansion valve 22 includes a generally elongate housing 82 having a generally cylindrical inner chamber 84. A first or upper support member 86 is threadingly received into the upper end 88 of housing 82 and a second or lower support member 90 is threadingly received into the lower end 92 of housing 82. Housing 82 further includes a partition member 94 disposed at the mid section of inner chamber 84 so as to form a upper outlet chamber 96 and a lower inlet chamber 98. Partition member 94 includes a central aperture 100 for allowing fluid communication between inlet chamber 98 and outlet chamber 96. Central aperture 100 includes a conically tapered portion 102 and a downwardly facing annular shoulder 104 for receiving a roulon 106. Roulon 106 has an outer tapered surface conforming with tapered portion 102 and its upper terminal end bears against downwardly facing shoulder 104. Further roulon 100 has a central aperture 101, which together with a portion of central aperture 100, forms an orifice between chambers 98 and 96. The interior cylindrical surface of the bore of roulon 106 projects radially inward beyond the cylindrical facing surface of member 94. Housing 82 also includes a threaded inlet port 108 and a threaded outlet port 110 for threadingly receiving an inlet pipe 112 and an outlet pipe 114, respectively.

Expansion valve 22 further includes a valve element 120 having an upper stem 121 which extends through the orifice formed by central apertures 100, 101. The upper end of valve stem 120 extends through a central aperture 122 in upper support member 86 and has attached to the upper end thereof a first or upper pressure disk 124. Valve element 120 includes a lower adapter 126 having its lower end received within a centralized bore 128 in lower support member 90 and its upper end attached or integral with the lower end of stem 121 and extending into inlet chamber 98. Lower adapter 126 includes at least one seal member 127 for sealing engagement with the internal wall of support member 90 forming centralized bore 128. A second or lower pressure disk 130 is disposed adjacent the lower terminal end of adapter 126. An annular valve member 132 is disposed around the upper terminal end of adapter 126 for sealing engagement with the downwardly facing valve seat 134 on roulon 106. Adapter 126 includes an annular bore 136 for housing a coil compression spring 140 biasing pressure disk 130 downwardly and valve element 120 upwardly.

Upper support member 86 includes a counterbore 142 in its upper end for receiving upper pressure disk 124. A first diaphragm 144 extends across the upper terminal end of housing 82 to enclose pressure disk 124 within counterbore 142. A closure cap 146 is threadingly received over the upper exteriorly threaded end 88 of housing 82 securing the periphery of diaphragm 144. The diaphragm 144 and upper support member 86 with counterbore 142 form an enclosed chamber 148 housing upper pressure disk 124. Diaphragm 144 and upper closure cap 146 form an upper pressure chamber 150. Chambers 148 and 150, as well as conduit 76 and probe 74, form fluid systems which are filled with fluids, i.e. liquids and vapor, such as are used in the refrigeration system. The fluid systems should not just include liquids since then only liquid pressure would be applied to the diaphragms 144, 154. This allows pressures to be generated by the vapor pressures, caused by the boiling point of the liquid refrigerant, which gives an indication as to the temperature of the location at which the sensing element is placed.

Pressure chamber 150 is operatively connected to a thermal sensing probe 74. Probe 74 is thermally connected to the outlet end 42 of the evaporator coil 20 which is connected to the suction line 26 to the compressor 12. Probe 74 may comprise, for example, a thermal bulb. The fluid in the probe 74, the conduit 76, and the pressure chamber 150 preferably comprises an appropriate fluid, such as the same refrigerant which is contained in the refrigeration system, to respond to temperature changes in the temperature ranges to which the probe 74 is exposed to effect corresponding pressure changes at the pressure disk 124 to contribute to the control of valve 22.

The lower end of lower support member 90 includes a counterbore 152 for housing lower pressure disk 130. A diaphragm 154 extends across the lower terminal end of housing 82 and across counterbore 152 so as to enclose pressure disk 130. A lower closure cap 156 is threadingly received over exterior threads on the lower end 92 of housing 82 thereby securing diaphragm 154. Cap 156 may be made of stainless steel. Lower support member 90 with counterbore 152 and diaphragm 154 forms an enclosed chamber 158 for housing lower pressure disk 130. Lower closure member 156 and diaphragm 154 form a lower pressure chamber 160. Both chambers 158 and 160 are typically filled with fluids such as are used in the refrigeration system. Optionally, either a thermal sensing probe 78, similar to that of probe 74, may be operably connected to chamber 160 or a temperature sensing plate, such as a copper member 162, is placed in a suitable location in the refrigeration system 10, such as in the path of the return air 44 to the evaporator system 18 as illustrated, or in the refrigeration area (not shown) being cooled by the cooled air flow 46 discharged from the evaporator system 18, or in the path of the discharge air flow 46, for example. A heater (not shown) may be placed adjacent the probe 78 to raise the temperature and provide for the closure of the valve 22.

Lower pressure disk 130, associated with the refrigerant air, has a smaller cross-sectional area than that of upper pressure disk 124 associated with the evaporator inlet temperature. As will be hereinafter described in further detail, lower pressure disk 130 has approximately 60% of the cross-sectional area of upper pressure disk 124. Thus, a greater pressure force is required on lower pressure disk 130 to balance a smaller pressure force placed on upper pressure disk 124. In other words, a lower temperature is required at sensor probe 74 to produce a pressure force on larger, upper pressure disk 124 in order to balance the pressure force placed by a higher temperature of the refrigerant air on the smaller, lower pressure disk 130 at the set point.

As shown in FIG. 2, a heating element 164 may be disposed within sensor member 162 to operatively control the temperature of the fluids in the lower pressure chamber 160 by heating the fluids within lower pressure chamber 160 to increase the fluid pressure on lower pressure disk 130 and thus on the lower end of valve element 120 which in turn causes an increase in the flow through the valve 22. By raising the temperature sufficiently, the valve can be made to close.

Vent ports 166, 168 extend from the outlet 110 to enclosed chambers 158, 148, respectively. Vent ports 166, 168 are disposed in the wall of housing 82. Vent ports 166, 168 provide a fluid pressure communication across the valve element 120. The enclosed chambers 148, 158 are in fluid pressure communication with outlet chamber 96. The evaporator coil pressure is thus equalized across the valve element 120 causing valve 22 to be a balanced port valve.

A filter member 170 may be disposed on the inlet pipe 112. Filter member 170 includes an elongate tubular housing 172 having an inlet end 174 for receiving liquid refrigerant such as from reservoir 16 via line 38. An outlet 176 is provided in the wall of housing 172 for communicating with inlet chamber 98 of valve 22. A filter 180, such as a sieve or wire mesh, is disposed within the housing 172 for filtering the liquid refrigerant prior to flowing into valve 22. The lower end of housing 172 is closed by a removable threaded cap 182 having a central aperture 184 therethrough for receiving a relief or poppet member 186 having a shaft that extends exteriorly of cap 182. Poppet member 186 includes a washer-like head 185 which seals with an inwardly directed flange on the lower end of housing 172. A spring 188 is housed within housing 172 for biasing poppet member 86 to the closed position as shown in FIG. 2. Poppet member 186 may be depressed inwardly so as to allow the pressurized liquid refrigerant to cause any accumulation to pass through aperture 184 and clean filter 180 without removing cap 182. See also U.S. Pat. No. 5,232,015 incorporated herein by reference.

A feedback restrictor 190 is mounted on the end of outlet pipe 114. Restrictor 190 includes a generally elongate body 192 which includes a cylindrical bore 194 that extends generally transversely to the axis of outlet pipe 114. Body 192 includes a reduced diameter portion 196 at its lower end forming an upwardly facing seat 198. A flow control member 200 is reciprocably mounted within bore 194. Member 200 is threaded at 202 to internal threads on housing 192. Member 200 is reciprocated within housing 192 on threads 200 by the rotation of a nut 204 at its upper end. A servo motor could be placed on member 200 to automatically adjust the flow area 210. A cap 205 is placed over nut 204 during operation to hermetically seal around nut 204. A valve element 206 is disposed on the lower end of member 200 and includes a downwardly facing conical surface 208 adapted for controlling the annular flow area at 210 between valve element 206 and reduced diameter portion 196. First and second thermisters 212, 214 may be disposed on member 200 for measuring the flow through area 210. Thermister 212 is disposed upstream in bore 194 and thermister 214 is disposed downstream of flow area 210 in line 220. Flow through member 192 may also be measured using sensors 216, 218 which are mounted on outlet pipe 114 at the inlet of member 192 and on line 220 extending from the outlet of member 200. The temperature sensors 216, 218 are placed outside on the piping so as to avoid placing any thermisters 212, 214 inside the piping.

The amplifier 192 has a set point which is adjusted by adjustable nut 204. A restriction in the flow area 210 of restrictor 190 creates a back pressure on diaphragms 144, 154 which tends to close the valve. The amount of the restriction in flow area 210 determines how fast the gain is.

During the operation of the valve 22, the positioning of the annular valve member 132 on valve element 120 with respect to the valve seat 134 on roulon 106, is controlled by the forces acting at the opposite, terminal ends of the valve element 120. The distance between member 132 and seat 134 determines the size of the annular flow area 135 and thus the flow rate.

The larger upper pressure disk 124 disposed in enclosed chamber 148 engages the upper terminal end of valve element 120. The conduit 76 extending to evaporator outlet probe 74 is sealed to the valve housing 82 and is in fluid communication with the interior of upper pressure chamber 150. The pressure chamber 150, conduit 76 and thermal probe 74 are fluid-filled so that the rise in temperature due to the heating of the refrigerant causes an increase in fluid pressure within chamber 150 which is communicated to the upper pressure disk 124. The force applied to the valve element 120 by the upper pressure disk 124 is the product of the pressure of the fluid times the cross-sectional area $A_1$ of pressure disk 124. This pressure force tends to move valve element 120 downwardly to the valve open position.

The smaller lower pressure disk 130 disposed in enclosed chamber 158 engages the lower terminal end of valve element 120. Preferably, the valve 22 is properly located, as previously described, within the refrigeration air such that the heat from the air is conducted through sensor plate 162. Since the lower pressure chamber 160 is fluid filled, a rise in the air temperature $T_A$ causes an increase in the temperature and thus the pressure of the fluid within lower pressure chamber 150 thereby increasing the force against lower pressure disk 130. The force applied to the valve element 120 by lower pressure disk 130 is the product of the pressure of the fluid times the cross-sectional area $A_2$ of pressure disk 130. This pressure force tends to move valve element 120 upwardly to the valve closed position.

Compression spring 140 is compressed between adapter 126 and lower pressure disk 130. The spring 140 thus exerts a force that is determined by the amount of compression of the spring and the spring constant. It will be appreciated that the spring 140 and the lower pressure plate 130 may both apply forces on the valve element 120 in the upward direction as viewed in FIG. 2, and the upper pressure plate 124 may apply a force on the valve element 120 in the opposite, or downward, direction, with each force tending to move the valve element 120 in the direction of the applied force. Spring 140 is a closing spring such that if the valve element 120 floats, i.e. the internal valve pressure forces diaphragms 144, 154 off of pressure disks 124, 130, respectively, the spring 140 will force the valve element 120 to move upwardly and close the valve 22. An additional spring (not shown) may be placed such that it is providing a force between adapter 126 and support member 90.

The pressure of the refrigerant itself exerts force that affects the tendency of the valve element 120 to be moved in the valve chamber 84 to alter the flow rate through the valve 22. Disregarding friction as a factor for purposes of simplicity and clarity, these forces interact in determining the configuration of the valve 22 to control the flow of refrigerant to the evaporator coil 20. The net effect on the valve element 120, that is, the determination of the position of the valve member 132 relative to the valve seat 134, is due to the sum of the longitudinal forces applied to the valve element 120 and to the pressure disks 124, 130. These forces, therefore, determine the size of the annular flow area 135.

Referring now to FIGS. 1 and 2, during operation of the refrigeration system 10, the liquid refrigerant 36 is conveyed to the valve 22 by the conduit 38. The refrigerant 36 first passes through filter member 170 where the refrigerant 36 is filtered and then passes through the valve inlet port 108 into the inlet chamber 98. The liquid refrigerant is metered through annular flow area 135 and orifice 100 from high pressure to low pressure. The refrigerant 36 then passes into outlet chamber 96 and out through the outlet port 110. The refrigerant begins to change state upon traversing the outlet port 110 and the outlet pipe 114. The fluid then flows through feedback restrictor 190. Depending upon the size of annular flow area 210 in feedback restrictor 190, a back pressure may be created to adjust the flow rate. The refrigerant then enters into the inlet end 40 of the evaporator coil 20 as a liquid and vapor mixture.

As the refrigerant passes through the evaporator coil 20, the liquid refrigerant is boiling at the inlet end 40 of the evaporator 20 at a temperature $T_1$. The liquid refrigerant tends to evaporate as it progresses through the coil of evaporator 20. Thus, the refrigerant is a vapor at the outlet end 42 of the evaporator 20 at a temperature $T_2$. To ensure superheat, the temperature $T_2$ must be between temperature $T_A$ and $T_1$. Ideally, temperature $T_2$ is 60% of temperature $T_A$. Thus, lower pressure disk 130 has 60% of the surface area of upper pressure disk 124 to maintain the ideal temperatures. The control point is .6 between the two temperatures. As the valve 22 increases the flow of liquid refrigerant into the inlet 40, the temperature $T_2$ at the outlet 42 is decreased relative to the inlet temperature $T_1$.

There is a pressure drop across the adjustable restriction 210 of feedback restrictor 190. As the restriction 210 closes, a higher pressure is created in outlet chamber 96 which is vented underneath diaphragms 144, 154. Thus, as the flow through restrictor 190 decreases, a higher pressure is created which tends to shut the valve 22. Fluid feedback to the control function is provided through vent ports 166, 168. To adjust the size, nut 204 is rotated to adjust the flow clearance at 210. The thermisters 212, 214 measure the temperature differential across flow area 210 which indicates the flow rate through area 210. This flow rate is used in diagnostics. See U.S. Pat. No. 4,651,535 incorporated herein by reference.

Heating element 164 may be turned on to increase the temperature within chamber 160 causing an expansion of the fluid in chamber 160 and allowing the valve to close by moving valve element 120 upwardly. If the refrigerant is heated up, it expands and applies pressure to pressure disk 154 causing the valve element 120 to reciprocate and decrease the flow rate.

The heater 164 may also be used to shut off the back flow through valve 22 during reverse flow for defrosting. The heater can heat the refrigerant in chamber 160 so as to create such a high pressure that the back pressure through orifice 100 is overcome and the valve element 120 reciprocates upwardly to close the valve 22. Thus the expansion valve has a normally "on" operating state and applying heat decreases or shuts off the flow regardless of which direction the refrigerant is flowing.

Roulon 106 allows reverse flow during defrost. If a pressure is applied to the upper side of roulon 106, it will lift roulon 106 off of conical seat 102, open orifice 100, and allow back flow through valve 22. Back flow through the valve 22 causes a pressure to be applied to the roulon 106 and moves it off of conical seat 102 and against member 132 on valve stem 120 causing valve stem 120 to move downwardly and open the valve 22. The back flow causes a pressure differential across roulon 106 such that the back force unseats roulon member 106 and moves the valve element 120 downwardly to open the valve 22.

The valve 22 of the present invention has integral and proportional control. The fluid pressures in pressure chambers 150, 160 due to temperature sensing probe 74 and sensing plate 162, respectively, provide the integral control and the feedback restrictor 190 provides the proportional control. The forces placed on each end of valve element 120 are due to the temperature differences between the temperature $T_2$ at the evaporator outlet 42 and the return air temperature $T_A$ which allow the shifting of the set point. The feedback restrictor 190 allows more stable control of valve 22 to prevent over feeding or under feeding the evaporator 20 with liquid refrigerant 36. Thus, an optimum setting is achieved.

Figure 3:
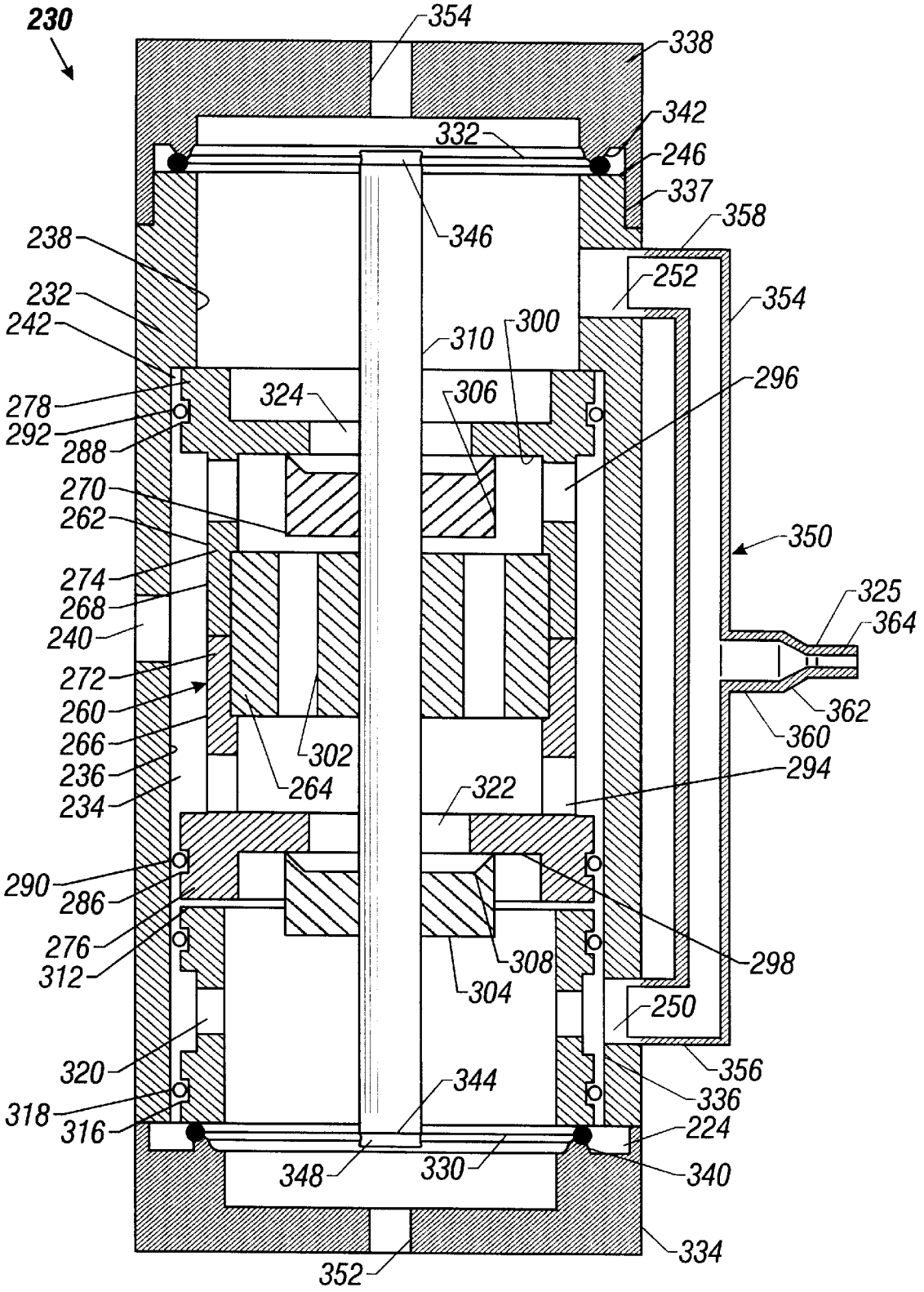
FIG. 3 is an enlarged, cross-sectional view of an alternative embodiment of the expansion valve according to the present invention utilized in the system illustrated in FIG. 1.

Referring now to FIG. 3, there is shown an alternative preferred embodiment expansion valve 230 in accordance with the present invention for use in the closed loop vapor cycle refrigeration system 10, shown generally in FIG. 1. Expansion valve 230 preferably includes a generally elongate housing 232 having a generally cylindrical inner bore or chamber 234 formed by an enlarged diameter portion 236 and a reduced diameter portion 238. An annular shoulder 242 is formed at the transition between portions 236 and 238. Valve housing 232 includes an inlet port 240 located at the mid portion of housing 232 and a pair of outlet orifices 250, 252 located adjacent the terminal ends 244, 246, respectively, of housing 232.

A valve assembly 260 is disposed within chamber 234 of valve housing 232. Valve assembly 260 includes an inner seat member 262, a valve element support member 264 and a valve element 270.

Inner seat member 262 includes two mating, generally cylindrical members 266, 268. Members 266, 268 are substantially identical and include two generally cylindrical sleeve members 272, 274, respectively, having end flanges 276, 278, respectively. End flanges 276, 278 include valve openings 322, 324 to allow fluid communication between inlet port 240 and outlet orifices 250, 252, as hereinafter described in further detail. Sleeve members 272, 274 also include counter bores 280, 282 at one end which together form an annular notch when sleeve members 272, 274 are mated at 284. Annular end flanges 276, 278 each include a outer groove 286, 288 for receiving a seal member 290, 292, respectively, such as an elastomeric 0 -ring, for sealingly engaging the inner cylindrical wall formed by chamber 234 of valve housing 232. Upon assembly, the end flange 278 engages annular shoulder 242 in valve housing 232. Sleeve members 272, 274 also include a plurality of ports 294, 296, respectively, azimuthally spaced around their circumference. End flanges 276, 278 also form valve seats 298, 300, respectively, for engagement with valve element 270, as hereinafter described.

Valve element support member 264 is generally cylindrical and has a length which allows support member 264 to be received and supported within the annular notch formed by counter bores 280, 282 upon mating members 266, 268 at 284. Valve element support member 264 also includes a plurality of longitudinal bores 302 azimuthally spaced around the circumference thereof to provide fluid communication between ports 294 and 296. It should be appreciated that valve element support member 264 may be eliminated if valve stem 121 can be supported at each end by diaphragms 330, 332. This would reduce any friction during the movement of valve stem 12l.

Valve element 270 includes a pair of annular valve members 304, 306, each with an annular sealing lip 308. Valve elements 304, 306 are mounted dimensionally on valve stem 310 such that sealing lips 308 simultaneously engage valve seats 298, 300 as shown in FIG. 3 to restrict or close valve openings 322, 324, respectively. Thus valve 230 includes two valves and two seats. It should be appreciated that valve elements 304, 306 are releasably connected to valve stem 310 for purposes of assembly.

A spacer sleeve 312 is also disposed in chamber 234 of valve housing 232 and abuts end flange 276 at 312. Spacer sleeve 312 is generally cylindrical and includes a pair of annular grooves 316 with seal members 318 disposed therein, for sealingly engaging the wall of enlarged diameter portion 236. Spacer sleeve 312 also includes a plurality of ports 320 azimuthally spaced around its circumference. Ports 320 permit fluid communication between inlet port 240, through ports 294, 296 and valve opening 322, to outlet orifice 250.

Two channels of flow are formed through valve 230, a first channel from inlet 240, through ports 294, 296 and bores 302, then through valve opening 324, outlet orifice 252, and conduit 354, to valve outlet 325 and a second channel from inlet 240, through ports 294, 296 and bores 302, then through valve opening 322, outlet orifice 250, and conduit 354, to valve outlet 325. Since fluid flows through both channels and passes through both of the valve openings 322, 324, the valve openings 322, 324 are preferably the same size and the outlet orifices 250, 252 into conduit 354 are preferably the same size so as to prevent an unbalanced pressure drop across the valve openings 322, 324. It is preferred to have the same flow areas through both the first and second flow channels of valve 230.

A return air diaphragm 330 extends across the terminal end of spacer sleeve 312 and a coil outlet diaphragm 332 extends across the terminal end 246 of valve housing 332. Return air diaphragm 330 is enclosed by an end cap 334 which is threadingly received at 336 over the terminal end 244 of valve housing 332. Likewise, end cap 338 is threadingly received at 337 over the terminal end 246 of valve housing 232. End caps 334, 336 include annular knife edged projections 340, 342, respectively, which engage diaphragms 330, 332, respectively, for holding diaphragms 330, 332 in position.

A pressure plate may be disposed on each end 344, 346 of valve stem 310, depending upon the material of diaphragms 330, 332, for supporting adjacent diaphragms 330, 332. If the diaphragms 330, 332 are made of stainless steel, a plate is not necessary. If the material of diaphragms 330, 332 is plastic, a pressure plate supporting the plastic may be desirable. The areas of diaphragms 330, 332 are the same without regard to whether a pressure plate or diaphragm only is being used. The particular material for the diaphragms 330, 332 dictates whether the force equals the pressure times the area of the diaphragm. If the material of the diaphragm has a certain rigidity, the effective area may be less than the actual area of the diaphragm. However, this effective area can be calculated. The effective area may be less than the actual area because the valve housing 232 will tend to support a portion of the pressure load on the diaphragm depending upon the rigidity of the diaphragm material. If the diaphragm is substantially rigid, then the effective area is substantially equal to the actual area of the diaphragm.

The terminal ends 344, 346 of valve stem 310 are mounted on diaphragms 330, 332, respectively. Thus the diaphragms 330, 332 at each end of the valve housing 232 support the valve stem 310 and valve elements 302, 304. Each terminal end of the valve stem 310 is mounted at the center of the diaphragms 330, 332. One method of mounting valve stem 310 on diaphragms 330, 332 is to provide an aperture in the center of diaphragms 330 and 332 through which is inserted a threaded screw cap 348 which then threads into a tapped bore in each end 344, 346 of valve stem 310.

The present invention substantially reduces any friction generated due to the shifting of the valve stem 310 within valve housing 232. Multiple channels have been provided through the valve housing 232 to eliminate the need for any seals which sealingly engage the valve stem 310 as it shifts within the valve housing 232. Thus there are no seals to introduce friction opposing the movement of the valve stem 310. Further, the number of supports for valve stem 310 is limited to the center valve support 264 . Since the diaphragms 330, 332 support the valve stem 310, the valve stem 310 may be described as floating within the valve housing 232. By reducing friction, diaphragms 330, 332 may smaller and still be sufficiently sensitive to changes in pressures because less force is required to shift valve stem 310. Further, hysteresis forces are eliminated. Thus, by minimizing any friction, valve 230 is more sensitive to temperature changes and this is particularly true at lower temperatures. Friction is particularly a problem at small temperature changes because a small change in temperature may not produce sufficient pressure change to overcome the friction to move the valve stem.

End caps 334, 338 also include a return air aperture 352 and a coil outlet aperture 354, respectively. Return air aperture 352 is connected to conduit 80 which in turn is in fluid communication with probe 78. Likewise, coil outlet aperture 354 is connected to conduit 76 which in turn is in fluid communication with probe 74. Probe 74 is disposed at the outlet of the evaporator 20, such as by strapping the probe 74 to the exterior of the conduit carrying refrigerant to the evaporator 20, while probe 78 is disposed externally of the evaporator 20. Either a thermal bulb or a copper plate (such as copper member 162 shown in FIG. 2), which is exposed to the return air, may be used to produce a pressure on diaphragm 330 which represents the temperature of the return air. Also, a heater, such as heating element 164 shown in FIG. 2, may be placed adjacent the return air diaphragm 330 to close the valve 230 if desired. A thermal bulb is preferred because it is more effective than a cooper plate, although a thermal bulb is more expensive. For defrosting the evaporator, it is necessary that the flow of refrigerant be reversed through the evaporator 20. During defrosting, the valve may be opened using roulons in the valve seats 298, 300 around the valve openings 322, 324 such as those used and described with respect to FIG. 2.

A feedback assembly 350 is disposed on valve housing 232. Feedback assembly 350 includes a conduit 354 having ends 356, 358 which are connected to outlet orifices 250, 252, respectively. An outlet restricter 360 is mounted and in fluid communication with conduit 354 and includes a restricting member 362 having a reduced flow area at valve outlet 325. Restricting member 362 includes an attached conduit 364 which is in fluid communication with the inlet end 40 of evaporator 20. Although the present invention does not require an adjustable restriction at the outlet 325 of valve 230, it should be appreciated that the flow area of valve outlet 325 may be variable. For example, restricting member 362 may be releasably mounted on conduit 354 to allow the use of restricting members with varying flow areas as desired. Also, the feedback restrictor 190 shown in FIG. 2 may be adapted for use with feedback assembly 350 to adjust the flow area at valve outlet 325. By having an adjustable orifice at the outlet 325 of the valve, the valve may be used for a range of applications.

Figure 4:
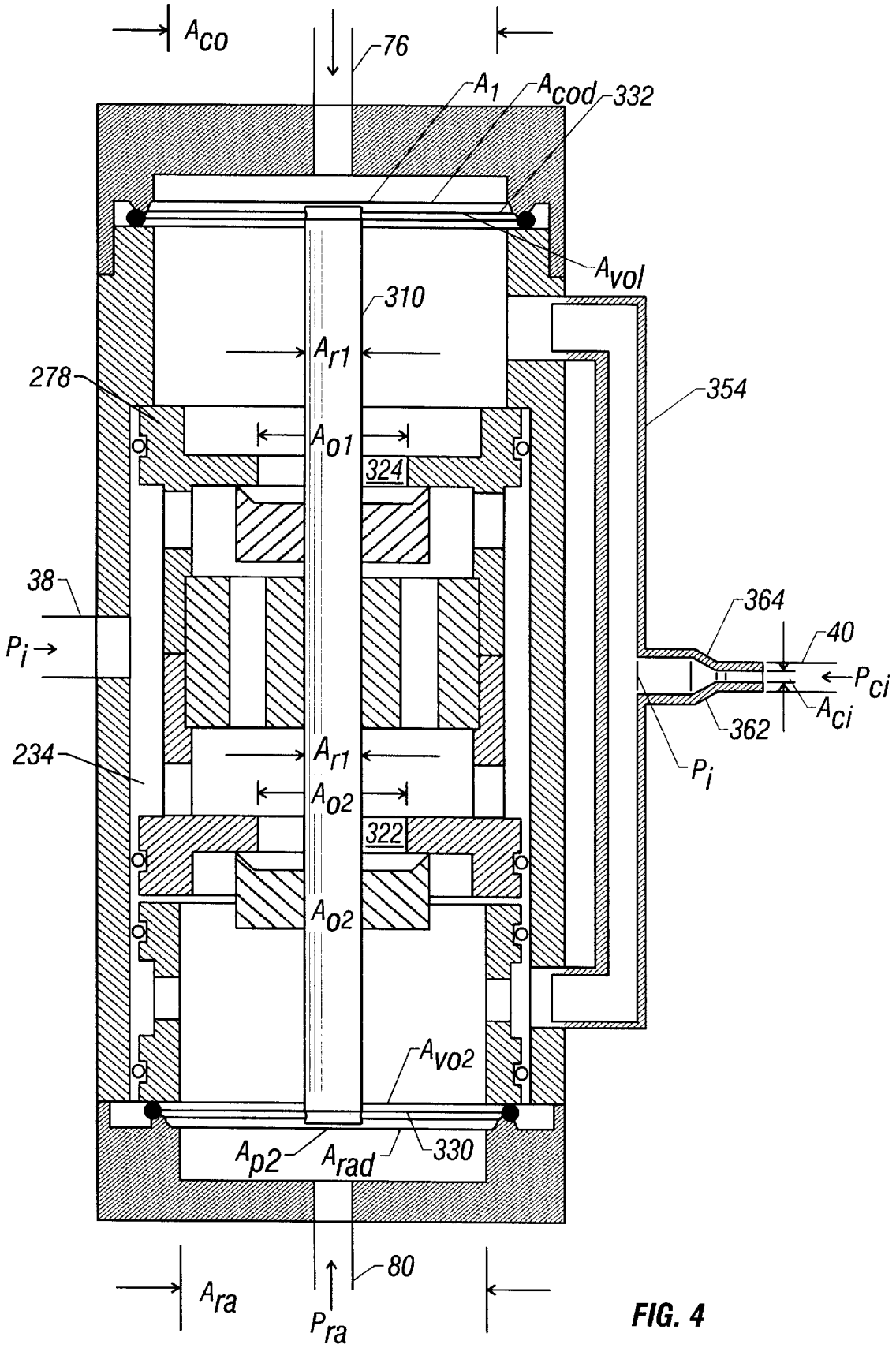
FIG. 4 is an enlarged, cross-sectional view of an alternative embodiment of the expansion valve according to the present invention utilized in the system illustrated in FIG. 1 and showing the parameters relating to flow through the valve.

Referring now to FIG. 4, the liquid refrigerant line pressure $P_1$ is the pressure of the liquid refrigerant in conduit 38 in fluid communication with reservoir 16. The coil outlet temperature bulb vapor pressure $P_{co}$ is the vapor pressure resulting from the temperature changes in the fluid within conduit 76 and probe 74 located at the coil outlet 42 of evaporator 20 as a result of the refrigerant at outlet 42. The return air temperature bulb vapor pressure $P_{ra}$ is the vapor pressure resulting from the temperature changes in the fluid within conduit 80 and probe 78 due to the return air external to probe 78. The internal valve outlet intermediate pressure $P_i$ is the pressure of the refrigerant in conduit 354. The evaporator coil inlet pressure $P_{ci}$ is the pressure of the refrigerant at the evaporator coil inlet 40. It should be appreciated that the evaporator coil inlet pressure $P_{ci}$ is the same as the pressure at the outlet of the restricting member 360 of the valve 230. The valve metering orifice area $A_{o1}$ is the area of port 324 of end flange 278 and the valve metering orifice area $A_{o2}$ is the area of port 322 through end flange 276. The cross-sectional area $A_{r1}$ is the cross-sectional area of the valve stem 310 adjacent diaphragm 332 and the cross-sectional area $A_{r2}$ is the cross-sectional area of the valve stem 310 adjacent diaphragm 330. Diaphragm area $A_{vo1}$ is the area of the diaphragm 332 on the chamber 234 side of the diaphragm and the diaphragm area $A_{vo2}$ is the diaphragm area of diaphragm 330 on the chamber 234 side. The coil outlet diaphragm area $A_{cod}$ is the area of the diaphragm on its coil outlet side and the return air diaphragm area $A_{rad}$ is the area of the diaphragm on its return air side. The connecting screw area $A_{p1}$ is the cross-sectional area of the connecting screw 348 at end 346 of valve stem 310 and the connecting screw area $A_{p2}$ is the area of the connecting screw 348 at end 344 of valve stem 310. The valve outlet restriction area $A_{ci}$ is the cross-sectional area of restricting member conduit 364. The area $A_{co}$ exposed to coil outlet bulb vapor pressure $P_{co}$ can be expressed as: $A_{co}=A_{cod}+A_{p1}$. The area $A_{ra}$ exposed to return air bulb vapor pressure $P_{ra}$ can be expressed as: $A_{ra}=A_{rad}+A_{p2}$.

The force equation for diaphragms 330, 332 and valve assembly 270 is:

$$F=P_{co}*(A_{cod}+A_{p1})-P_i*A_{vo1}+P_i*A_{o1}-P_1*A_{o1}-P_{ra}*(A_{rad}+A_{p2})+P_i*A_{vo2}-P_i*A_{o2}+P_1*A_{o2}$$

In the steady state condition, all forces on the valve stem 310 may be added together and made equal to zero since the force F=0.

Solving the force equation in terms of $P_i$ where F=0, $$P_i*A_{vo1}-P_i*A_{o1}+P_i*A_{vo2}-P_i*A_{vo2}=P_{co}*(A_{cod}+A_{p1})-P_1*A_{01}-P_{ra}*(A_{rad}+A_{p2})+P_1*A_{o2}$$

Since $A_{o1}=A_{o2}$, then $P_i*A_{vo1}-P_i*A_{vo2}=P_{co}*(A_{cod}+A_{p1})-P_{ra}*(A_{rad}+A_{p2})$ Solving for $P_i$, $P_i=$ $$\text{Solving for } P_i,\ P_i=\frac{P_{co}(A_{cod}+A_{p1})-P_{ra}(A_{rad}+A_{p2})}{A_{vo1}-A_{vo2}}$$

The cross-sectional area of valve stem 310 is to be made as small as possible and therefore is assumed to be small as compared to the cross-sectional area of diaphragms 330, 332. Thus, assume $A_{p1}<<A_{cod}$ and $A_{p2}<<A_{rad}$. Further, in the preferred embodiment shown in FIG. 3:

$A_{vo1}=A_{cod}$ and $A_{vo2}=A_{rad}$.

$$\text{Substituting,}\quad P_i = \frac{A_{cod}P_{co} - A_{rad}P_{ra}}{A_{cod} - A_{rad}}$$

$$\text{Let } R_{cod} = \frac{A_{cod}}{A_{cod} - A_{rad}} \text{ and } R_{rad} = \frac{A_{rad}}{A_{cod} - A_{rad}}$$

$$\text{Substituting,}\quad P_i = R_{cod}P_{co} - R_{rad}P_{ra}.$$

The flow equation for volumetric flow through the valve outlet 325 at restricting member 362 is:

$$N=k*A_{ci}*\sqrt{P_i-P_{ci}}$$

where k=a constant such as $\sqrt{2}g\Delta P/\rho$.

The flow equation shows that the flow through an orifice is proportional to the square root of the difference in pressures across the orifice and that the cross-sectional area of the orifice determines the slope of the curve depicted on a graph of flow versus pressure.

Substituting $P_i$ in the flow equation:

$$N=k\,A_{ci}(R_{cod}P_{co}-R_{ra}P_{ra}-P_{ci})^{1/2}$$

Note that the flow area of the valve inlet 240 of the valve 230 does not appear in the final calculations. Thus, the only impact on fluid flow through the valve 230 is any reduced flow due to friction.

In operation, the temperatures external to probes 74, 78 heats or cools the fluids in the probes 74, 78 depending whether the temperatures are increasing or decreasing. The temperatures of these fluids in return generates the bulb vapor pressures $P_{co}$ and $P_{ra}$, respectively. The temperature of the air flowing externally to the evaporator 20 generates the pressure $P_{ra}$ and the temperature of the liquid passing through the outlet 42 of the evaporator 20 generates the bulb vapor pressure $P_{co}$. The temperature probe 78 may be located either in the return air 44 or in the discharge air 46. Bulb vapor pressure $P_{ra}$ is then applied to areas $A_{rad}$ plus $A_{p2}$ and bulb vapor pressure $P_{co}$ is applied to area $A_{cod}$ plus $A_{p1}$. It can be seen that if the pressure at the coil outlet 42 increases, the valve 230 will move to a further open position and the flow through the valve inlet 240 will increase. Likewise, if the temperature of the return air increases, the valve 230 will move to a further restricted position and the flow through the valve inlet 240 will decrease.

It is important that evaporator 20 operate at superheat temperatures at the outlet 42 of the evaporator 20 to insure that all liquid refrigerant has turned to a gas refrigerant by the time it reaches outlet 42. For example, if the refrigerant boils at 15° F. when it is under a 10 psi pressure, a superheat temperature is any temperature above 15° F. Thus, so long as the temperature at the outlet 42 is maintained at a superheat level, i.e. above 15° F. in this example, it is assured that all of liquid refrigerant has turned into a gas. If the temperature at the outlet is 20° F., then it is said to be 5° superheated. Assuming that the temperature is 15° F. at the evaporator coil inlet 40, then all of the liquid would have turned to gas by the time it reached outlet 42 and the outlet temperature may have risen 5° to a temperature of 20° F. Superheat is always desirable to be sure that all of the liquid has turned into a gas by the time it reaches the outlet 42 of the evaporator 20. Thus, when the temperature at the evaporator outlet 42 goes up, the superheat temperature is rising. Since the present invention is a constant flow valve and is not dependent on the liquid line pressure $P_1$ the superheat of valve 230 is independent of the liquid line pressure $P_1$.

One objective of the valve 230 of the present invention is to produce ratiometric forces from the signals of the return air and coil outlet. In the preferred embodiment, this is achieved by a ratio of diaphragm sizes. It has been determined that a fully flooded evaporator coil is achieved if the temperature at the evaporator outlet is two-thirds the difference between the return air temperature and the evaporator inlet temperature. This range controls valve 230 best. Thus, the area $A_{ra}$ of the return air diaphragm 330 is preferably 60% of the area $A_{co}$ of the evaporator outlet diaphragm 332. However, the valve would also work at other ratios, such as diaphragm 330 being one half the size of diaphragm 332 or even if diaphragms 330 and 332 were the same size. Where the area $A_{ra}$ of the return air diaphragm 330 would be one-half the area $A_{co}$ of the coil outlet diaphragm 332, when the return air temperature is one-half the temperature at the evaporator inlet 40, the valve 230 closes.

$$\text{Assuming}\quad A_{cod} = 2A_{rad}$$

$$R_{cod} = -\frac{2A_{rad}}{2A_{rad} - A_{rad}} = 2$$

$$R_{rad} = \frac{A_{rad}}{2A_{rad} - A_{rad}} = 1$$

$$N = kA_{ci}(2P_{co} - P_{ra} - P_{ci})^{1/2}$$

$$\text{Thus, if flow} = 0,\ \text{then}\ P_{co} = \frac{P_{ra} + P_{ci}}{2}$$

Figure 5:
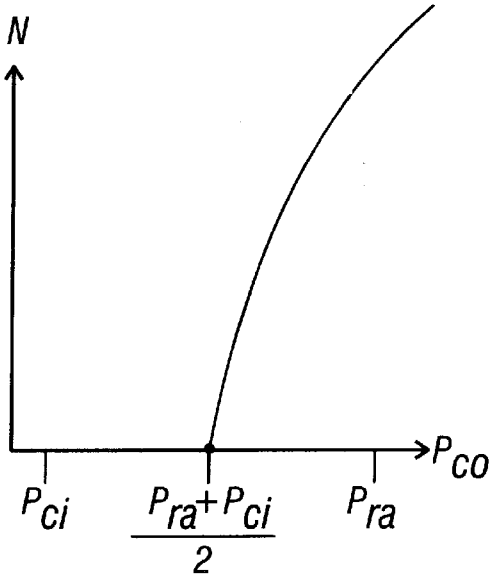
FIG. 5 is a graph of flow versus bulb vapor pressure at the evaporator coil outlet.

The graph of FIG. 5, which not to scale, plots flow rate N versus bulb vapor pressure $P_{co}$ at the coil outlet. If the flow rate N is zero, the bulb vapor pressure $P_{co}$ at the coil outlet 42 equals one-half the bulb vapor pressure $P_{ra}$ of the return air plus the pressure $P_{ci}$ of the coil inlet. The zero flow rate will always be at a pressure which is one-half the return air bulb vapor pressure $P_{ra}$ plus the coil inlet pressure $P_{ci}$. The zero point stays one-half of the sum of these two pressures where the ratiometric forces are two to one with $A_{rad}$ being one half of $A_{cod}$. It should be appreciated that predetermined relative ratiometric forces may be produced by other mechanical means other than by varying the relative size of the diaphragms 330, 332. The set point shifts, resets, if the return air bulb vapor pressure $P_{ra}$ rises and this shifts the curve shown in FIG. 5. This is the automatic adjustment upon the shifting of the bulb vapor pressure $P_{ra}$ of the return air. The flow area or size of the orifice at the outlet of the valve 230 determines the slope of the curve shown in FIG. 5.

Figure 6:
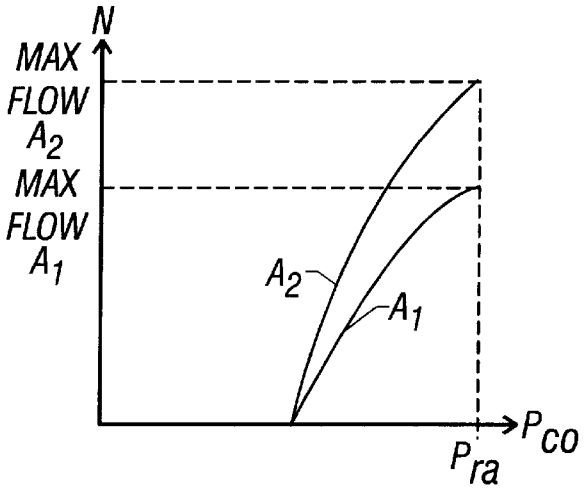
FIG. 6 is a graph of the percentage the valve is opened versus return air bulb vapor pressure.

Referring to the graph shown in FIG. 6, it is preferred to have full flow through valve 230 at a given set point for the return air bulb vapor pressure $P_{ra}$ to allow full utilization of the valve 230. By adjusting the flow area of the outlet 325 of the valve 230, the slope of the curve can be adjusted such that the valve 230 operates in the fully opened position at a given return air pressure $P_{ra}$.

When there is no restriction at the valve outlet, the flow through the valve is determined by the superheat. At a particular superheat temperature, the valve has a particular sized opening. However, if the liquid line pressure $P_1$ is increased, then the pressure drop across the valve element increases and the flow increases. Thus in a conventional valve, changing the line pressure changes the flow rate through the valve. The valve 230 of the present invention is port balanced and configuring the feedback allow the valve 230 to function independent of the liquid line pressure $P_1$. It also produces a constant volumetric flow rate N at a particular return air vapor pressure $P_{ra}$ and coil inlet pressure $P_{ci}$.

The restriction to flow at the valve outlet 325 caused by restricting member 362, creates a back pressure on the fluid flow through the valve 230 and on diaphragms 330, 332. Thus, as the fluid pressure increases at the valve inlet 240, the back pressure caused by restricting member 362 also increases, such that the flow area through the valve outlet 325 of restricting member 362 determines the amount of gain. If there was no restriction at the outlet 325 of valve 230, the pressure at the inlet 240 would be substantially the same as the pressure at the outlet 325 of valve 230 reduced only by the friction hindering flow through the valve. When the restriction is placed at the outlet 325, the pressure within conduit 354 increases. Because the diaphragm 332 for the coil outlet 42 is greater than the diaphragm 330 for the return air, the restriction applies a negative feedback tending to close the valve 230. Negative feedback tends to close the valve 230 and positive feedback tends to open the valve 230. The negative feedback applies the required closing force for valve 230 and thus no closing spring force is required as in the prior art. The more flow that goes through the valve inlet 240, the more flow that is attempted to pass through the restriction at the valve outlet 325 which only causes a greater feedback pressure in conduit 354 to close valve 230. The larger the pressure $P_1$ the greater the feedback pressure whereby a constant flow is maintained through the valve 230. An increase in the line pressure $P_1$ increases both the positive and negative feedback pressures. Thus, the valve 230 maintains a constant flow. The above derivation shows that there will be a constant volumetric flow through the valve 230 of the present invention. The volumetric flow is constant at a given vapor pressure of the return air $P_{ra}$ and given pressure at the coil inlet $P_{ci}$ since the volumetric flow through the valve 230 is not dependent upon the liquid line pressure $P_1$. Thus, the liquid line pressure $P_1$ can fluctuate and the volumetric flow rate N will not change at the valve outlet 325.

The pressure at the coil outlet $P_{co}$ depends upon the boiling point of the refrigerant and the suction pressure of the compressor 12 on the suction line 26 which is attached to the outlet 42 of the evaporator 20. The valve 230 then responds to the pressure at the coil outlet $P_{co}$. The pressure at the coil inlet $P_{ci}$ varies depending upon the air flow over the evaporator 20 and particularly the temperature of the air and the amount of air flow. If air flow increases, refrigerant flow should be increased through the evaporator 20. Also, as previously discussed, the refrigerant flow will change based on refrigeration requirements.

It should be appreciated that the volumetric flow rate (cubic fee per minute) at the inlet 240 of the valve 230 may be different from the volumetric flow rate at the outlet 325 of the valve 230. The liquid refrigerant partially expands into a gas as it passes through the valve 230 due to the pressure drop across the orifices 322, 324 at valve elements 304, 306 that causes the liquid refrigerant to boil off into a vapor. Thus, although liquid refrigerant enters the valve 230, a mixture of liquid and vapor passes through the outlet 325 of the valve 230. It is the density (pounds per minute) of the fluid refrigerant passing through the valve 230 which actually changes between the inlet 240 and the outlet 325. Further this density will change as a result of a change in the liquid line pressure $P_1$. The flow equation relates to volumetric flow through the outlet 325 of the valve 230. Referring to the flow equation, the flow rate is dependent upon the vapor pressure of the return air $P_{ra}$, the pressure at the coil inlet $P_{ci}$ and the pressure at the coil outlet $P_{co}$ It is not dependent upon the liquid line pressure $P_1$. Thus it can be seen that the volumetric flow rate N is independent of liquid line pressure $P_1$. In conventional expansion valves, an increase in the liquid line pressure will cause an increase in the volumetric flow through the outlet of the valve. The valve 230 of the present invention provides a feedback pressure which prevents increased volumetric flow through the valve outlet 325 and maintains the same volumetric flow through the valve outlet 325.

Referring again to the flow equation, the gain, which is the slope of the curve shown in FIG. 5, is a function of the area $A_{ci}$ of the outlet 325 of the valve 230. A larger area $A_{ci}$ increases the gain and thus increases the volumetric flow N through the expansion valve 230. Thus, if to increase the gain, the area $A_{ci}$ of the outlet 325 is increased which then permits a greater flow rate N through the valve outlet 325.

Further, it should be appreciated that the valve 230 is not independent of liquid line temperature. A decrease in the liquid line temperature causes less gas to boil off as the liquid refrigerant passes through the valve 230. Thus as the liquid line temperature becomes cooler, more liquid refrigerant will pass out the outlet 325 of the valve 230.

The embodiment of valve 230 does not have an adjustment to the size of the flow area at the outlet 325 of the valve other than by changing to a other restrictor 360 having a different orifice size. It is set merely by the ratio of the areas of diaphragms 330, 332. If the area $A_{co}$ of the coil outlet diaphragm 332 is much greater than the area $A_{ra}$ of the diaphragm 330 for the return air, a large feedback is created providing a high gain.

A negative feedback could be introduced into valve 230 by narrowing the negative feedback orifice 252 as compared to the positive feedback orifice 250 such that there is a perpetual negative feedback pressure on the flow through the valve 230. If the cross section at orifice 252 were less than the cross section at orifice 250, the smaller orifice 252 would provide a restriction to flow and provide a back pressure which would be applied to the larger diaphragm 332 for the evaporator outlet 42. This then would tend to close the valve 230. Likewise, if orifice 250 were larger than orifice 252, the back pressure which would be created would tend to open the valve 230. If the sizes of orifices 252, 250 were adjustable, then the negative and positive feedback would also be adjustable which would allow an adjustable gain. It probably would be preferable to only use the negative feedback and not the positive feedback so as to achieve a higher gain. This would permit larger flows through the valve 230. Orifice 252 would no longer be restricted. However, it is preferred to have the positive and negative feed back balanced, both statically and dynamically.

The feedback pressure gives valve 230 of the present invention flexibility not available in conventional valves. The present invention allows the same valve to be used over a range of tonnages without changing the size of the orifice as in conventional valves. Since the valve is not dependent upon the liquid line pressure $P_1$, the valve is not sensitive to tonnage for the amount of refrigerant flow that passes through the valve. The present valve can operate over a wide range of load conditions, even over a 3 to 1 range.

It is advantageous to have the volumetric flow at the outlet 325 of the expansion valve 230 independent of the liquid line pressure $P_1$. The refrigeration system no longer is dependent upon the liquid line pressure $P_1$ being high. This is important because the pressure of the refrigeration system does not have to be elevated in cold weather. Thus, a fundamental reason for having the volumetric flow at the outlet 325 of the valve 230 independent of liquid volume pressure $P_1$ is to save energy. The constant volumetric flow through the outlet 325 of the valve 230 is one means of making the valve 230 independent of the liquid line pressure $P_1$. The constant flow mechanism of the expansion valve 230 of the present invention is to set the superheat without regard to a fluctuating liquid line pressure $P_1$.

Figure 7:
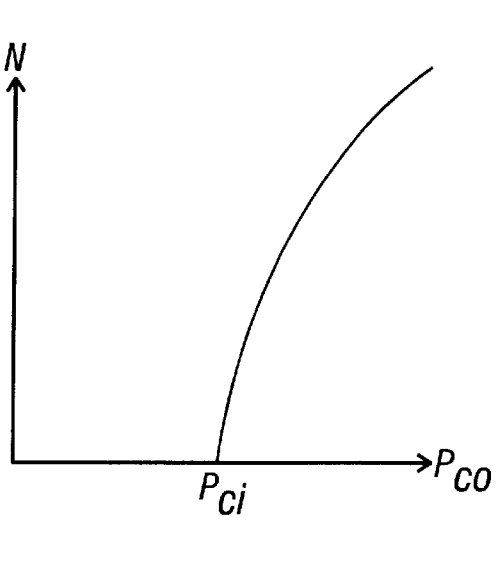
FIG. 7 is a graph of flow versus bulb vapor pressure at the evaporator coil outlet with a valve only having a coil outlet bulb vapor pressure diaphragm.

In a conventional expansion valve having a diaphragm for the coil outlet pressure to open the valve and a spring biasing the valve element to the closed position, the curve of FIG. 7 is shifted by the force of the spring. Therefore, adjusting the spring shifts the curve. In fact, the curve can be shifted past the zero pressure point at the coil outlet. This should never happen. The evaporator cannot operate below zero degrees superheat because all the refrigerant would not have changed from a liquid into a gas by the time it reached the outlet of the evaporator. If the spring is set to operate the valve by opening the valve at a particular temperature and the load drops, then liquid will flow past the probe 74 at the coil outlet 42. In this situation, a conventional expansion valve will not shut off and prevent liquid refrigerant from flowing through the coil outlet 42. Liquid refrigerant should never flow out the coil outlet 42.

It should be appreciated that a conventional expansion valve can be modified to utilize the feedback pressure feature of the present invention. Referring again to FIG. 2, the diaphragm 154 for the return air can be eliminated and replaced with a compression spring which bears against lower pressure disk 130. Temperature sensing plate 162 would be replaced with a releasable bottom cover against which the compression spring would bear. Of course the feedback restrictor 190 would still be used to place a feedback pressure in chamber 84. The compression spring also can be eliminated with the feedback pressure performing the function of the compression spring. Without a compression spring, the valve would be set at zero degrees superheat and at its lowest flow rate.

Even a valve without a return air diaphragm, still has the advantage that the valve will never flood. If the diaphragm for the return air is removed, the feedback prevents flooding. The set point can be zero, and the valve will not flood. With the negative feedback of the present invention, the valve will close before it operates below a superheat condition.

A conventional valve is not a balanced port valve and will operate even better if the conventional valve had equalizer ports 166, 168 equalizing the upstream and downstream pressures. Thus the pressure at the low pressure side at outlet 110 would be the same as the pressures in chambers 148 and 158. Without the balanced ports, the conventional valve could shift the curve, shown in FIG. 5, to the left to below zero such that the pressure at the coil outlet would be less than superheat. Spring 140 closes the valve when the pressure within chamber 84 is greater than the vapor pressures on the diaphragms 144, 154 and diaphragms 144, 154 separate from pressure plates 124, 130. If seal 127 is eliminated, spring 140 can also be removed. If the spring 140 were removed and the seal 127 remained, the valve element 120 would tend to remain stationary and not close the valve.

A still further improvement would be the attach the upper end of stem 121 to diaphragm 144. Then the feedback pressure would replace the need for a compression spring.

If there is an error in the temperature reading at probe 74, such as for example, a 2° difference between the probe reading and the actual temperature of the refrigerant at the coil outlet 42, then the curve is slightly offset below zero. This error can be corrected by placing a small check valve in the valve to provide a sufficient restriction to flow to compensate for the error. The restriction would be designed to introduce a 2 psi offset to automatically take into account the reading differential between the probe and the coil outlet pressures.

The foregoing disclosure and description of the invention is illustrative and explanatory thereof, and various changes in the method steps as well as the details of the apparatus, such as ratiometrically applying the forces with different techniques such as pulleys, levers, different refrigerants, or the like, may be made within the scope of the appended claims without departing from the spirit of the invention.

What is claimed is:

1. An apparatus for controlling the flow of refrigerant fluid through an evaporator in a refrigeration system comprising a self-adjusting thermally powered expansion valve having a back pressure for controlling fluid flow downstream of the valve independently of the fluid pressure upstraem of the valve, said valve has an inlet and an outlet for passage of fluid through the valve and a valve element intermediate the inlet and outlet such that the position of the valve element determines the flow passage area for flow between the inlet and outlet, a first probe for sensing the temperature at a first location and providing a fluid pressure that is representative of the sensed temperature to configure the valve element for controlling the flow of refrigerant fluid through the orifice, and a second probe for sensing the temperature at a second location and providing a fluid pressure that is representative of the sensed temperature to configure the valve element for controlling the flow of refrigerant fluid through the orifice.

2. The apparatus as in claim 1, further comprising:

a first force generator, operable by application of fluid pressure thereto for applying force tending to move the valve element in a first direction tending to close the flow passage area to flow; and a second force generator, operable by application of fluid pressure thereto for applying force tending to move the valve element in a second direction tending to open the flow passage area to flow.

3. The apparatus as in claim 1, wherein said first probe is located in the air external to the evaporator.

4. The apparatus as in claim 1, wherein said second probe is located at the evaporator outlet.

5. The apparatus as in claim 1, wherein:

said first probe is in fluid pressure communication with the first force generator and applies fluid pressure to the first force generator that is representative of the temperature external of the evaporator; and said second probe is in fluid pressure communication with the second force generator and applies fluid pressure to the second force generator that is representative of the temperature sensed at the evaporator outlet.

6. A valve as defined in claim 5 wherein the first force generator produces force in response to a quantity of fluid pressure applied thereto that is smaller than force produced by the second force generator in response to the same quantity of fluid pressure applied thereto.

7. A valve as in claim 5 wherein the first and second force generators comprise first and second bellows, respectively, and the first operable area of the first bellows for generating forces to configure the valve element is smaller than the second operable area of the second bellows for generating forces to configure the valve element.

8. A valve as in claim 7 wherein the first operable area is approximately 60% of the second operable area.

9. A valve as in claim 2 wherein:

the valve element is a sliding valve element;

the first force generator operatively connects to the valve element on one side thereof;

the second force generator operatively connects to the valve element the opposite side thereof; and at least one fluid pressure communication passage communicating fluid pressure from downstream of the valve to said first and second force generators.

10. A valve as in claim 2 further comprising a spring for applying a force tending to move the valve element in the first direction.

11. An apparatus for cooling at least one refrigerated area in a refrigeration system, comprising:

an evaporator having an evaporator inlet and an evaporator outlet;

a thermo-mechanical expansion valve having an inlet and an outlet for the passage of refrigeration fluid through the valve and a valve element intermediate the inlet and outlet such that the position of the valve element determines the flow passage area for flow between the inlet and outlet, the outlet being connected to the evaporator inlet;

a force generator representative of the refrigerated area's temperature operably connected to the valve element; and an opposing force generator representative of the temperature at the outlet of the evaporator operably connected to the valve element, the resultant forces of the force generators controlling the flow passage area; and a restrictor creating a back pressure at the outlet whereby the flow passage area and back pressure meter refrigeration fluid into the evaporator inlet in response to a change in the compartment air temperature.

12. The apparatus of claim 11 wherein said force generator controls the closing of said orifice of said thermo-mechanical expansion valve to restrict the metering of liquid into the inlet of said evaporator in response to an increase of the temperature at the evaporator outlet.

13. A method of controlling the flow of refrigerant to an evaporator of a refrigeration system comprising the steps of:

passing liquid refrigerant into the inlet of a self-adjusting expansion valve;

placing a back pressure on the refrigerant flow through the valve;

controlling refrigerant flow downstream of the valve independently of the refrigerant pressure upstream of the valve;

maintaining the temperature at the outlet end of the evaporator lower than the temperature external to the evaporator and higher than the temperature within the evaporator; and sensing the temperature of the air external to the evaporator and applying a quantity of fluid pressure that is representative of the sensed temperature to configure the valve.

14. A method as defined in claim 13 further comprising:

increasing refrigerant flow when the temperature of the air external to the evaporator decreases, or the temperature at the outlet end of the evaporator increases, or the pressure in the evaporator decreases; and decreasing refrigerant flow when the temperature of the air external to the evaporator increases, or the temperature at the outlet end of the evaporator decreases, or the pressure in the evaporator increases.

15. A method as defined in claim 13 further comprising:

increasing refrigerant flow when the difference between the temperature at the outlet end of the evaporator and the temperature within the evaporator increases, or the difference between the temperature of the air external to the evaporator and the temperature within the evaporator decreases; and decreasing refrigerant flow when the difference between the temperature at the outlet end of the evaporator and the temperature within the evaporator decreases, or the difference between the temperature of the air external to the evaporator and the temperature within the evaporator increases.

* * * * *